US012305866B2

(12) United States Patent
Nalini et al.

(10) Patent No.: US 12,305,866 B2
(45) Date of Patent: May 20, 2025

(54) SUPPORT ASSEMBLY FOR A MOTOCONDENSING UNIT

(71) Applicant: CAREL INDUSTRIES S.p.A., Brugine (IT)

(72) Inventors: Luigi Nalini, Brugine (IT); Daniele Cazzin, Brugine (IT)

(73) Assignee: CAREL INDUSTRIES S.P.A., Brugine (IT)

( * ) Notice: Subject to any disclaimer, the term of this patent is extended or adjusted under 35 U.S.C. 154(b) by 380 days.

(21) Appl. No.: 17/759,684

(22) PCT Filed: Feb. 12, 2021

(86) PCT No.: PCT/IB2021/051173

§ 371 (c)(1),
(2) Date: Jul. 28, 2022

(87) PCT Pub. No.: WO2021/161239

PCT Pub. Date: Aug. 19, 2021

(65) Prior Publication Data

US 2023/0054907 A1 Feb. 23, 2023

(30) Foreign Application Priority Data

Feb. 13, 2020 (IT) ..... 102020000002872

(51) Int. Cl.
*F24F 1/56* (2011.01)
*F24F 1/22* (2011.01)
(Continued)

(52) U.S. Cl.
CPC ..... *F24F 1/56* (2013.01); *F24F 1/22* (2013.01); *F24F 1/46* (2013.01); *F24F 13/32* (2013.01);
(Continued)

(58) Field of Classification Search
CPC ..... F24F 1/56; F24F 1/60; F24F 1/46; F24F 1/22; F24F 13/32; F24F 13/20; F24F 2013/202; F24F 2013/207; F25D 23/006
See application file for complete search history.

(56) References Cited

U.S. PATENT DOCUMENTS 2,959,939 A * 11/1960 Arzberger ..... F25D 11/00 62/283
4,153,310 A * 5/1979 Loving ..... F24F 1/56 174/559
2016/0178248 A1* 6/2016 Lim ..... F24F 1/56 62/498

FOREIGN PATENT DOCUMENTS

EP 3385626 A1 10/2018
JP S50148659 U 12/1975
(Continued)

OTHER PUBLICATIONS

English translation of Kim (KR-20010065566-A). (Year: 2001).*
International Search Report & Written Opinion dated May 4, 2021 from PCT Application No. PCT/IB2021/051173, 10 pages.

*Primary Examiner* — Miguel A Diaz
(74) *Attorney, Agent, or Firm* — INNOVATION CAPITAL LAW GROUP, LLP; Vic Lin

(57) ABSTRACT

Described is a support assembly (1) for a motocondensing unit (M), comprising an electronic unit (Me) and a mechanical unit (Mm). In particular, the support assembly (1) according to the invention comprises: —a first base (10), configured to support the electronic unit (Me) of the motocondensing unit (M), and having a first coupling side part (102); —a second base (20), configured to support the mechanical unit (Mm) of the motocondensing unit (M), and having a second coupling side part (202); wherein said first coupling side part (102) and said second coupling part (202) are configured to be coupled to each other in such a way that,
(Continued)

following the coupling of said first coupling part (102) and of said second coupling part (202), the first base (10) and the second base (20) form a monolithic body.

11 Claims, 7 Drawing Sheets

(51) Int. Cl.

| | |
|---|---|
| ***F24F 1/46*** | (2011.01) |
| ***F24F 13/20*** | (2006.01) |
| ***F24F 13/32*** | (2006.01) |
| ***F25D 23/00*** | (2006.01) |

(52) U.S. Cl.
CPC ..... *F25D 23/006* (2013.01); *F24F 2013/202* (2013.01); *F24F 2013/207* (2013.01)

(56) References Cited

FOREIGN PATENT DOCUMENTS

| | | | | |
|---|---|---|---|---|
| JP | H053823 | U | | 1/1993 |
| JP | H09243217 | A | | 9/1997 |
| KR | 20010065566 | A | * | 7/2001 |

* cited by examiner

SUPPORT ASSEMBLY FOR A MOTOCONDENSING UNIT

This invention relates to a support assembly for a motocondensing unit. In particular, the invention relates to a support assembly for a motocondensing unit of a commercial or industrial refrigerator.

In the refrigeration sector, it is known to make motocondensing devices comprising a motocondensing unit, which in turn has a mechanical unit and an electronic unit, and a support assembly to which the mechanical unit and the electronic unit of a motocondensing unit are stably associated.

Currently, it is known to produce support assemblies comprising a single base to which are associated the mechanical components and the electrical/electronic components of the mechanical unit and of the electronic unit of a motocondensing unit, respectively.

This is aimed at keeping the relative position between the components of the motocondensing unit stable and allow them to be handled as a single body. Only once the mechanical and electrical components are stably fixed to the single base of the support assembly can the operation of the mechanical unit and of the electronic unit be tested as a whole.

In particular, in order to test the correct operation of the mechanical unit, it is necessary to carry out seal tests in order to check that the various components of the mechanical unit, thus assembled, do not show or give rise to leaks.

For this purpose, helium leak tests are carried out using special apparatus comprising a vacuum chamber, which must be dimensioned so that it can contain the object to be tested. For this reason, the larger the size of the object to be tested, the larger the size of the equipment, particularly the vacuum chamber, must be. The cost of buying, or renting, such equipment varies mainly according to the size of the vacuum chamber.

In the context of the known technology, although it is only the mechanical unit that must be tested from the point of view of seal, the necessity of introducing inside the vacuum chamber not only the latter, but also the entire support assembly and therefore also the electronic unit, entails the necessity of resorting to apparatus with vacuum chambers having oversized dimensions with respect to the mechanical unit alone, with a consequent considerable increase in costs, as explained.

The main purpose of the invention is to create a support assembly which solves this problem by resolving the drawbacks of the prior art, as described above.

As part of this purpose, the aim of the invention to propose a support assembly which enables the testing operations of a motocondensing device to be improved. This aim, as well as these and other aims which will emerge more fully below are achieved by a support assembly for a motocondensing unit according to the appended claim 1 and by a refrigerator F according to claim 11. Detailed characteristics of the support assembly according to the invention are given in the corresponding dependent claims.

Further features and advantages of the invention will emerge more fully from the description of a preferred but not exclusive embodiment of the support assembly according to the invention, illustrated by way of non-limiting example in the accompanying drawings, in which.

Figure 1:
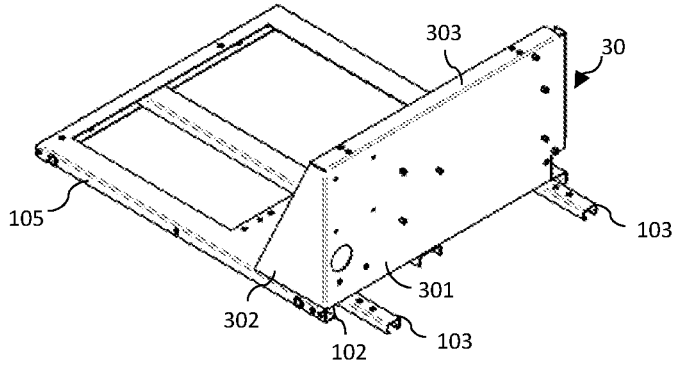
FIG. 1 illustrates a perspective view of a detail of a support assembly for a motocondensing unit, relating to a first frame and a partition wall according to the invention.
Figure 2:
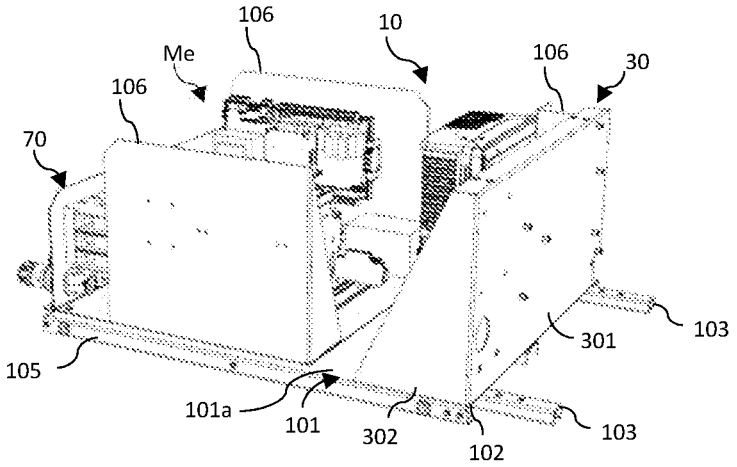
FIGS. 2 and 3 illustrate perspective views of a detail of a support assembly for a motocondensing unit according to the invention, with some parts removed to better highlight others.
Figure 3:
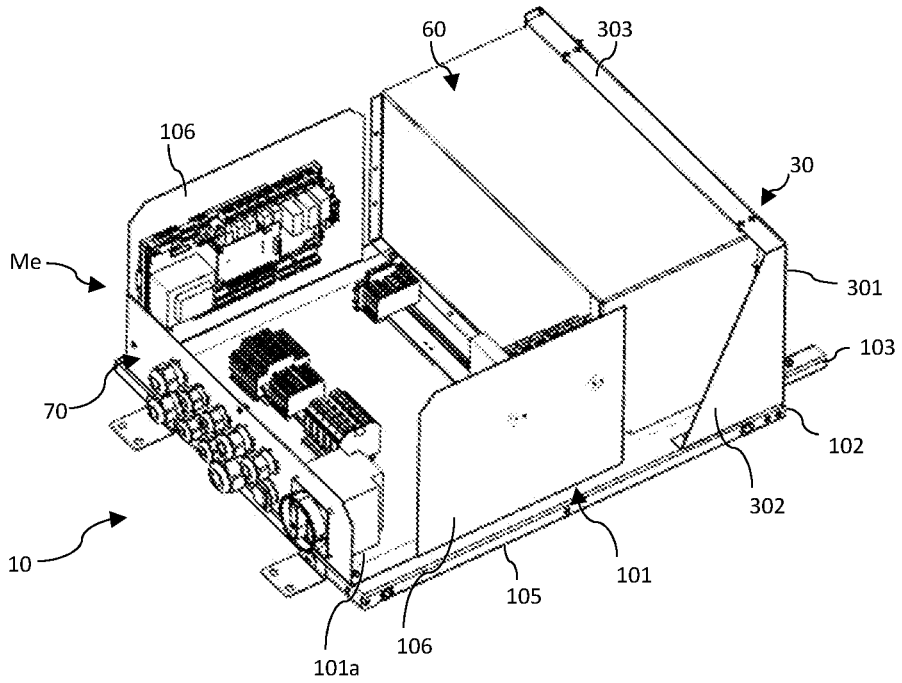
Figure 4:
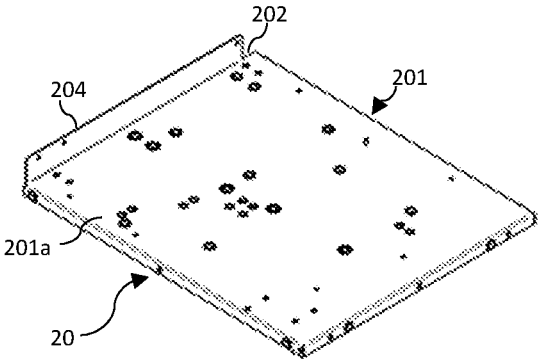
FIG. 4 illustrates a perspective view from above of a second base according to the invention.
Figure 5:
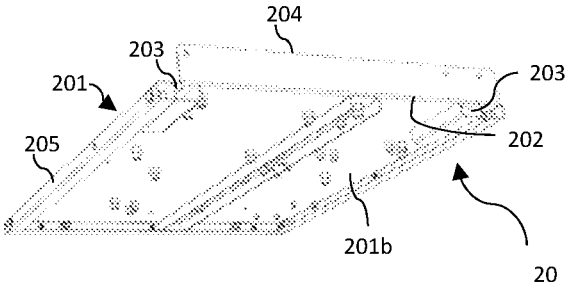
FIG. 5 illustrates a perspective view from below of a second base according to the invention coupled to an electronic unit.
Figure 6:
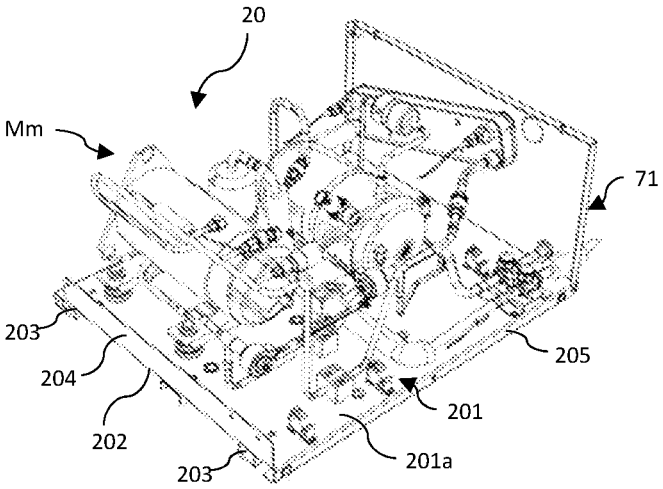
FIG. 6 illustrates a perspective view from above of a further detail of a support assembly for a motocondensing unit according to the invention, with some parts removed to better highlight others.
Figure 7:
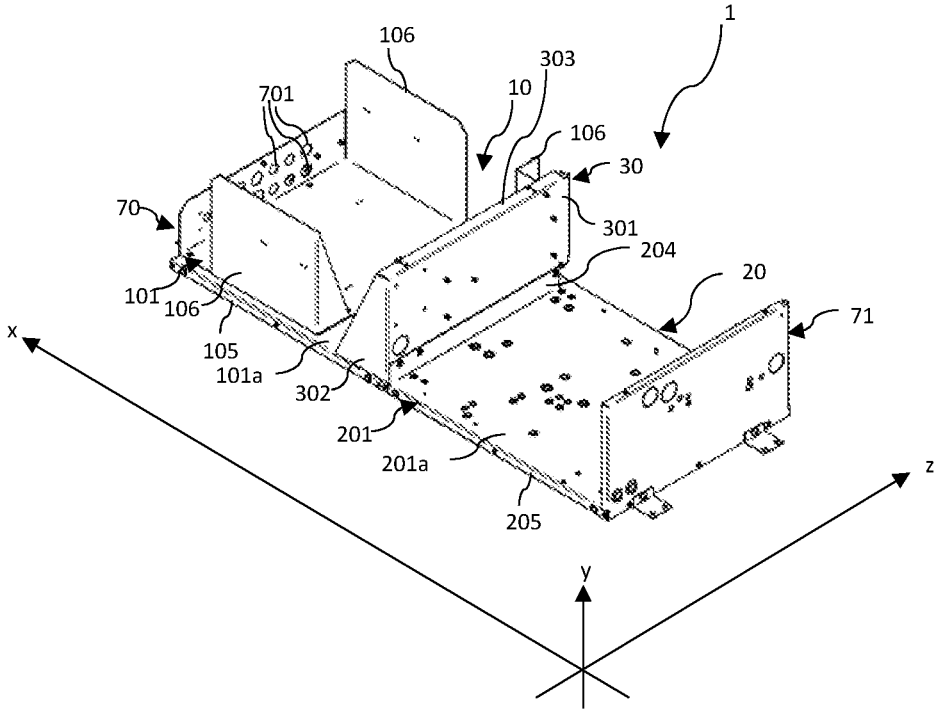
FIG. 7 illustrates a perspective view of a support assembly according to the invention.
Figure 8:
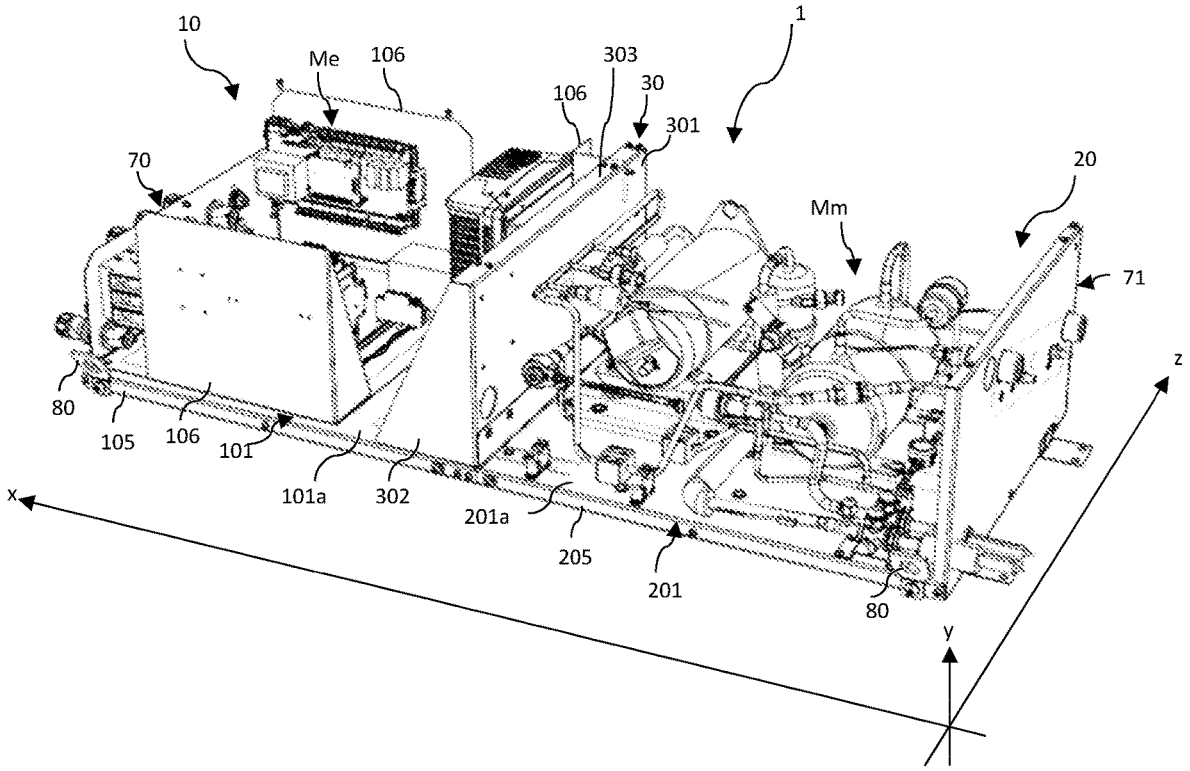
FIG. 8 illustrates a perspective view of a support assembly, according to the invention, coupled to a motocondensing unit.
Figure 9:
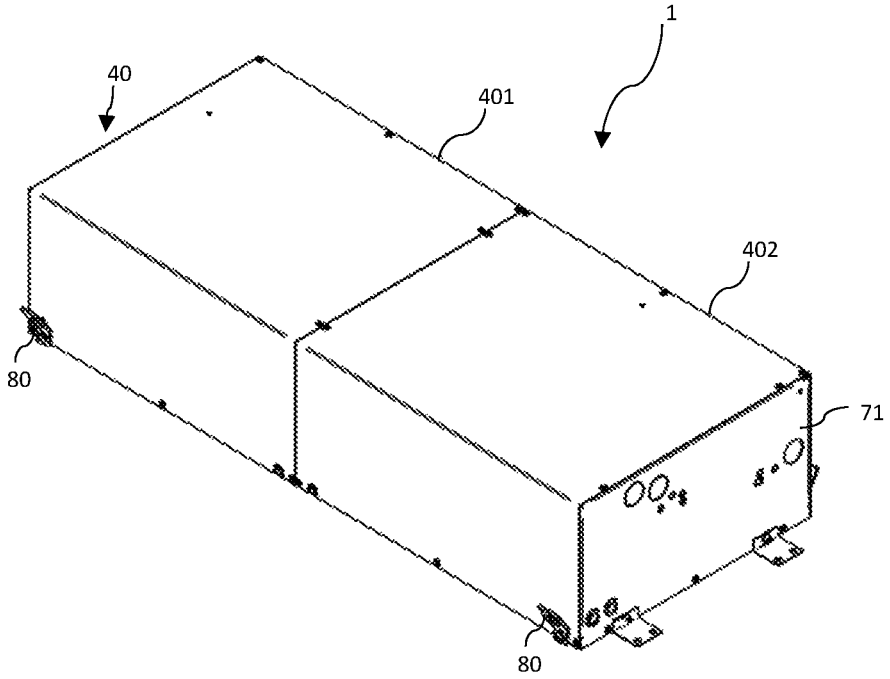
FIG. 9 illustrates a perspective view of a support assembly according to the present invention.
Figure 10:
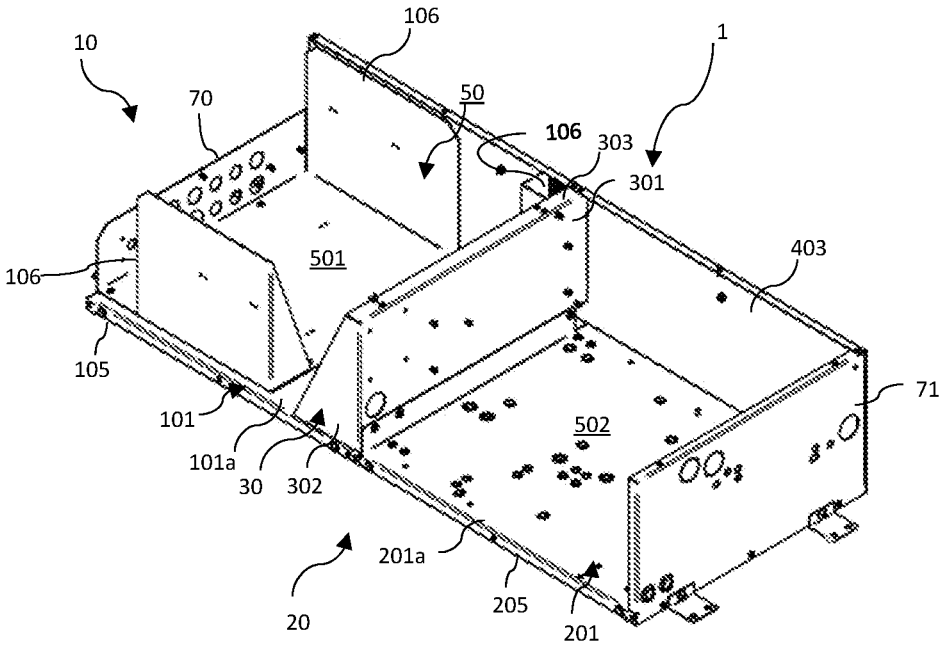
FIG. 10 illustrates a perspective view of a first base, a second base and a portion of a cover casing according to the invention.

With particular reference to the above-mentioned drawings, a support assembly for a motocondensing unit M of a refrigerator F is denoted in its entirety by the numeral 1. The motocondensing unit M and the support assembly 1, to which it is associated, are part of a motocondensing device. The support assembly 1 according to the invention is configured to support the motocondensing unit M. In particular, the support assembly 1 is configured to ensure the connection of the motocondensing unit M to the refrigerator F.

Specifically, the refrigerator F may have a compartment to hold products to be cooled. For example, the refrigerator F may be a refrigerator for industrial or commercial use, in which the above-mentioned compartment is also designed for displaying products, such as foodstuffs.

The refrigerator F may also comprise:

- a refrigeration exchanger, placed in thermal communication with the compartment, to cool it;
- a motocondensing unit M comprising an electronic unit Me, a mechanical unit Mm and a support assembly 1 as described below.

In particular, the mechanical unit Mm may comprise a refrigeration circuit branch extending between a first connector and a second connector wherein the first connector and the second connector are connected or connectable to the refrigeration exchanger.

In addition, the mechanical unit Mm may comprise, in sequence between the first connector and the second connector, a compressor, a heat exchanger, an expansion valve and a liquid/vapour separator.

The electronic unit Me can be connected to the mechanical unit Mm to power and control the operation of the components of the latter. In other words, the electronic unit Me is configured to operate the refrigeration branch of the mechanical unit Mm. In particular, the electronic unit Me may comprise a controller designed to actuate the compressor at a variable speed. Generally, an inverter is used as the controller.

Generally speaking, according to the invention, the support assembly 1 comprises:

- a first base 10, configured to support the electronic unit Me of the motocondensing unit M, and having a first side coupling part 102;

a second base 20, configured to support the mechanical unit Mm of the motocondensing unit M, and having a second coupling side part 202;

wherein the first coupling side part 102 and the second coupling side part 202 are configured to be coupled to each other in such a way that, following the coupling of the first coupling part 102 and of the second coupling part 202, the first base 10 and the second base 20 form a monolithic body.

In other words, the support assembly 1 is a modular structure. The first base 10 is a part or portion of the support assembly 1 configured for supporting or holding the electronic unit Me of the motocondensing unit M, and, similarly, the second base 20 is a part or portion of the support assembly 1 configured for supporting or holding the mechanical unit Mm of the motocondensing unit M.

The first base 10 and the second base 20 are both equipped with a coupling part, 102 and 202 respectively, configured to be mutually coupled or associated.

In particular, the first base 10 and the second base 20 can be coupled or associated with each other, by means of the respective coupling parts, 102 and 202, in such a way as to form after the mutual coupling a monolithic body, that is, a single and/or unitary and/or monobloc body which can be handled individually. For this reason, only following the coupling of the first coupling part 102 and of the second coupling part 202, can the first base 10 and the second base 20 be joined or combined to form a monolithic body. In other words, once associated with each other, the first base 10 and the second base 20 behave as a monolithic body, that is to say, which can be handled individually.

In production, it is therefore possible to separately couple the first base 10 to the electronic unit Me of the motocondensing unit M and the second base 20 to the mechanical unit Mm of the motocondensing unit M. As a result, it is possible to make a module of the motocondensing device, comprising an assembly of the motocondensing unit and the relative base, independently of the other module. This makes it possible to test the operation of the mechanical unit Mm individually, either pre-assembled or associated with the second base 20. Consequently, it is possible to limit the overall size of the portion of motocondensing device inserted into the vacuum chamber of the helium sealing test apparatus to just the mechanical unit Mm and the second base 20.

On the one hand, this allows the use of test apparatus for helium leak testing with a smaller vacuum chamber compared with that normally used in the prior art, thus reducing the investment costs for renting or purchasing the test apparatus. Moreover, on the other hand, as fewer components are subjected to the test, this limits the release of pollutants (resin particles, paint particles, etc.) from the components introduced into the vacuum chamber, with consequent improvement in the stability of operation of the test apparatus and the accuracy of the results which can be obtained from the test. In other words, the smaller the number of components or parts inserted inside the vacuum chamber, the lower is the risk that the test results will be falsified/disturbed.

In addition, the support assembly 1 according to the invention makes it possible to separate the production of the module comprising the electronic unit Me from that of the module comprising the mechanical unit Mm, both in terms of time and in terms of the production line. For example, the customisation of the electronic unit Me can take place at the time of order, independently of the mechanical unit Mm, the production of which can comprise the simple assembly of standard components, thus enabling the optimisation of the production cycle.

Lastly, the first base 10 and the second base 20 can be transported separately (once pre-coupled to the electronic unit Me and the mechanical unit of the motocondensing unit M, respectively) and assembled, in-situ, to form a monolithic body. In other words, there is no need to transport the motocondensing unit as one piece, but it is sufficient to assemble the two modules directly in-situ at the customer's site. Transport and assembly of the motocondensing device comprising the motocondensing unit M and the support assembly 1 is made easier.

In addition, the first coupling part 102 and the second coupling part 202 may be configured to achieve a stable coupling; that is to say, a coupling that is strong, not slack, not slow and which cannot be accidentally loosened. That is to say, the first coupling part 102 and the second coupling part 202 are configured to avoid or prevent random or accidental detachment or uncoupling.

It follows that the monolithic body formed as a result of the coupling of the first coupling part 102 and of the second coupling part 202 is capable of maintaining a reciprocal position between the first base 10 and the second base 20. For this reason, the maintaining of the reciprocal position between the electronic unit Me and the mechanical unit Mm, supported and/or associated, respectively, to the first base 10 and the second base 20, is also guaranteed. Consequently, when installed, even in the event of accidental impact to the refrigerator F, the probability of a disconnection occurring between the electronic unit Me and the mechanical unit Mm of the motocondensing unit M is minimised.

Moreover, the first coupling part 102 and the second coupling part 202 may be configured to establish a reversible coupling. That is to say, following coupling, the first coupling part 102 and the second coupling part 202 may be uncoupled or disassembled from each other, by mechanical dis-assembly or mechanical disconnection, without breaking or compromising the structural integrity of the coupling parts 102, 202. This can be particularly advantageous, for example, during maintenance or to correct an assembly error during the installation of support assembly 1.

In addition, the first coupling part 102 and the second coupling part 202 may be a peripheral or lateral part of the first base 10 and of the second base 20, respectively. In other words, the first coupling part 102 and the second coupling part 202 may correspond to a side or edge part of the first base 10 and the second base 20, respectively. The positioning of the coupling parts 102, 202 at a peripheral or lateral region or portion, that is, a side or edge part, of the first base 10 and of the second base 20 makes the coupling parts 102, 202 themselves more exposed, and therefore more accessible to an operator, further facilitating their coupling or association.

The coupling portions 102, 202 may comprise coupling means 103, 203, wherein the coupling means 103, 203 may comprise, in turn, at least one male element 103, projecting from the first coupling portion 102 or from the second coupling part 202, and a female element 203, fixed to the second coupling part 202 or the first coupling part 102, respectively, and wherein the male element 103 and the female element 203 are mutually complementary to achieve a shape coupling. Advantageously, the shape coupling of a male element 103 and a female element 203 makes the assembly, and possible disassembly, of the support assembly 1 particularly simple and fast. As a result, the assembly and installation time and costs of the support assembly 1, and of the associated motocondensing unit M as a whole, are considerably reduced.

In particular, a plurality of mutually complementary male elements 103 and a plurality of mutually complementary female elements 203 may be included to guarantee stability of the coupling. Moreover, in order to consolidate the coupling between the first base 10 and the second base 20, they may be provided with a plurality of constraint areas configured to accommodate screws, rivets or similar fasteners.

In particular, in order to ensure the minimum overall size of the second base 20, for the benefit of the helium chamber test phases, preferably, the at least one female element 203 may be associated with the second base 20 and the at least one male element 103 may be associated with the first base 10.

In particular, for reasons of constructional simplicity and economy, the at least one male element 103 may comprise a segment or section or piece of metal section; for example, a segment or section or piece of metal section with a rectangular or square cross-section.

In addition, the first base 10 may have a first support surface 101*a* and the second base 20 may have a second support surface 201*a*. In other words, the first base 10 and the second base 20 may have, respectively, a first support surface 101*a* and a second support surface 201*a*. The first support surface 101*a* may be configured to support one or more of the components of the electronic unit Me of the motocondensing unit M, and similarly, the second support surface 201*a* may be configured to support one or more of the components of the electronic unit Me of the motocondensing unit M. Moreover, the first base 10 may comprise a first lower surface 101*b* opposite the first support surface 101*a*, and similarly, the second base 20 may comprise a second lower surface 201*b* opposite the second support surface 201*a*.

With reference to the positioning of the at least one male element 103 and of the at least one female element 203, according to a particularly preferred configuration of the invention, the at least one female element 203 is associated with the second lower surface 201*b* of the second base 20. This positioning of the at least one female element 203 advantageously allows maximising the area of the second support surface 201*a* on which to arrange and fix the mechanical unit Mm of the motocondensing unit M.

Moreover, overall, the support assembly 1 may comprise:

- a cover casing 40 which can be fixed and/or is fixed to the first base 10 and to the second base 20 and configured to delimit, in cooperation with the first base 10 and the second base 20, a chamber 50;
- a partition wall 30, which can be associated and/or is associated with the first base 10 and/or with the second base 20, which projects from the first coupling part 102 and/or the second coupling part 202 with respect to the first support surface 101*a* and/or to the second support surface 102 and which divides said chamber 50 into a first compartment 501 for housing the electronic unit Me of the motocondensing unit M and into a second compartment 502 for housing the mechanical unit Mm of the motocondensing unit M.

As mentioned above, the support assembly 1 may also include a cover casing 40, protecting the electronic unit Me and the mechanical unit Mm of the motocondensing unit M. That is to say, the cover casing 40 can be placed to protect the electronic unit Me and the mechanical unit Mm of the motocondensing unit M. The cover casing 40 may be stably associated and/or is associated with the first base 10 and the second base 20. In particular, the cover casing 40 may be configured to define, in cooperation with the first base 10 and the second base 20, a chamber 50. The chamber 50 can serve as a protection chamber, and as insulation from the environment outside the same chamber, for the electronic unit Me and the mechanical unit Mm of the motocondensing unit M.

The cover casing 40 may be a one-piece element, that is, which can be handles individually, or alternatively may comprise a first portion 401 and a second portion 402. That is to say, the cover casing 40 may comprise a first portion 401, which can be associated and/or is associated with the first base 10 covering said first compartment 501, and a second portion which can be associated and/or is associated with said second base 20 covering said second compartment 502. Thus advantageously, in case of maintenance or interventions on the electronic unit Me or on the mechanical unit Mm of the motocondensing unit M, it is sufficient to remove only one of either the first portion of the cover casing 401 or the second portion of the cover casing 402. The first portion 401 and the second portion 402 can both be associated and/or are associated with said partition wall (30); wherein the first portion 401 and the second portion 402 are fixed respectively to the first base 10 and to the second base 20 and to the partition wall 30 so as to form a rigid unitary structure.

Preferably, in the case where there are a first portion 401 and a second portion 402 of cover casing, the cover casing 40 also includes a third portion 403, which is unitary, that is, one-piece, which is associated and/or can be simultaneously associated with the first base 10 and the second base 20. In this way, the structural rigidity of support assembly 1 is increased overall. In other words, the cover casing 40 may include three distinct portions: a third portion 403, which is associated and/or can be simultaneously associated with the first base 10 and the second base 20, a first portion 401, associated and/or which can be associated with the first base 10 and the third portion 403, and a second portion 402 associated and/or which can be associated with the second base 20 and the third portion 403.

Even more preferably, said third portion 403 comprises or consists of a third wall, that is to say, a side, closing the chamber 50.

The cover casing 40 may be structured in such a way as to have a high structural rigidity to contribute significantly to the overall stiffness of the support assembly, when attached to the bases 10 and 20.

In other words, in a preferred embodiment of the invention, the overall stiffness of the support assembly 1 is devolved to the structural cooperation of the first and second bases 10 and 20, the cover casing 40 and, advantageously, to the cooperation of the first 401, second 402 and third portions 403, once fixed to each other.

In this case, in order to avoid deformations, the support assembly 1, with the motocondensing unit M fixed thereto, may be handled, that is, moved, following the reciprocal fixing of its components, that is to say, the first and second bases 10 and 20 with the cover casing 40, which may be formed by the first portion 401 and second portion 402 and possibly also by the third portion 403.

Once associated with the first base 10 and the second base 20, and preferably also with the partition wall 30, the cover casing 40 advantageously allows the structure of the support assembly to be stiffened. This is particularly important in order to ensure that the morphological and structural integrity of support assembly 1 is maintained during installation operations. In fact, during installation, it is generally necessary to lift the first base 10 and the second base 20, to which the electronic unit Me and the mechanical unit Mm, respectively, are already associated. Greater structural stiffness makes it possible to limit the tendency to buckle in the event of lifting of the first base 10 or of the second base 20 due to a generally uneven distribution of the loads of the electronic unit Me and the mechanical unit Mm.

Moreover, preferably, for an increased strength and structural stiffness of the support assembly 1, the cover casing 40 is also fixable and/or fixed to the partition wall 30. This strengthening effect is particularly appreciable both in the case wherein the cover casing 40 is made of a single monobloc element, and in the case where it comprises a first portion 401, a second portion 402 and possibly a third portion 403.

The chamber 50 may result, therefore, subdivided by the partition wall 30 into a first compartment 501 and a second compartment 502, respectively configured to house the electronic unit Me and the mechanical unit Mm of the motocondensing unit M. Preferably, the first compartment 501 and the second compartment 502 are two physically separate spaces. That is, the first compartment 501 and the second compartment 502 are isolated from each other. In this way, a possible leakage of water, cooling fluid or lubricating oil from the mechanical unit Mm of the motocondensing unit M which can reach the electronic unit Me of the motocondensing unit M is prevented.

In addition, once associated with the first base 10 or the second base 20, the partition wall 30 makes it possible to advantageously stiffen the structure. In particular, the partition wall 30 contributes to increasing the stiffness and torsional strength of the first base 10, or the second base 20, with which it is associated. As with the cover casing 40, the partition wall 30 also contributes to maintaining the morphological and structural integrity, in particular, of the base with which it is associated, even during installation operations. Moreover, if, preferably, the cover casing 40 is associated with the partition wall 30, the latter further cooperates in the strengthening of the support assembly 1.

The partition wall 30 may preferably be associated and/or is associated with the first base 10. This reduces the size of the second base 20, which benefits the test phases, for example, in the helium chamber, as previously explained. Moreover, advantageously, the partition wall 30 can be used as an anchoring element for fixing one or more electrical components of the electronic unit Me or further components of the support assembly 1.

The partition wall 30 may advantageously allow for a thermal decoupling between the first compartment 501 and the second compartment 502, and consequently between the electronic unit Me and the mechanical unit Mm of the motocondensing unit. In use, the electronic unit Me and, especially, the mechanical unit Mm develop heat.

The partition wall 30 is configured to prevent or at least limit the passage of air between the first compartment 501 and the second compartment 502, as well as acting as a structural stiffening element.

This makes it easier to maintain the correct operating temperature of the electronic unit Me.

The latter can be equipped with a controller ventilation device, such as, for example, an inverter, in a traditional way.

The presence of the partition wall 30, configured as mentioned above, can advantageously act as a barrier to the air recirculation generated by the ventilation device. In this way, the partition wall 30 can act as a barrier, circumscribing the recirculation of air to only the volume of air present within the first compartment 501, making the ventilation device sufficient without requiring the presence of further ventilation devices which, on the other hand, in the absence of the partition wall 30, would be required to guarantee the recirculation of air in the entire chamber 50. Since the electrical/electronic components are particularly sensitive to temperature, it is possible in this way to prevent overheating, and consequent malfunction and deterioration, of the electronic unit Me without having to resort to additional ventilation devices beyond those traditionally associated with the controller(s) designed to actuate the compressor at variable speed.

By also limiting the action of the ventilation device(s) to the first compartment 501 only, the air recirculation path can be more easily defined and centred on the electrical/electronic components.

In addition, in order to reinforce this effect, the partition wall 30 can be insulated. This means that the partition wall 30 can be, at least in part, covered with a layer of insulating material, such as mineral wool, polystyrene, polyurethane, resins or other similar materials. Consequently, the partition wall 30 can further contribute to thermally insulating the first compartment 501 with respect to the second compartment 502.

In addition, the partition wall 30 may be provided with at least one through hole 303 for allowing the passage of connection cables connecting the electronic unit Me to the mechanical unit Mm of the motocondensing unit M, or the partition wall 30 may be provided with through-wall connectors. The partition wall 30 is, therefore, configured in such a way as to guarantee, by itself, the electrical connection between the electronic unit Me and the mechanical unit. Specifically, the presence of through-wall connectors particularly facilitates, at the time of installation, the electrical connection between the electronic unit Me and the mechanical unit Mm of the motocondensing unit M.

Preferably, the at least one through hole 303 has dimensions similar to or comparable with those of the connecting cable(s) passing through it in situ. In this way, the influence of the at least one hole 303 on the rigidity, on the air recirculation barrier function and on any thermal insulation capacity, of the partition wall 30 is limited. In addition, by limiting the size of at least one through hole 303, it is possible to contribute to the containment of the passage of radiation developed by the controller designed to actuate the compressor at variable speed. As explained below, the partition wall 30 may, in fact, also act as a barrier to the emission of radiation generated by the controller designed to actuate the compressor at variable speed; in this sense, the lower the number and/or the smaller size of the interruptions to the structural integrity of the partition wall 30, the greater is its contribution to the shielding of such radiation.

Preferably, the support assembly 1 may further comprise a first vertical wall 70, which may be associated and/or is associated with the first base 10, projecting with respect to the first support surface 101*a* from the opposite side with respect to the first coupling part 102. Preferably, said first vertical wall 70 may comprise one or more openings 701 designed for allowing the passage of power cables for the electronic unit Me. The support assembly 1 may also comprise a second vertical wall 71, which may be associated with and/or is associated with the second base 20, projecting with respect to the second support surface 201*a* on the opposite side with respect to the second coupling part 202. Preferably said first vertical wall 70 may comprise one or more openings 711 designed to house said first and second connectors connected or connectable to the refrigeration exchanger of the refrigerator F. Similarly to the partition wall 30, the first vertical wall 70 and/or the second vertical wall 71 may contribute to the structural rigidity of the first base and the second base 20, respectively.

Said first vertical wall 70 and/or said second vertical wall 71 may be an integral part of the cover casing 40.

In addition, the first base 10 and the second base 20 can extend mainly along a longitudinal direction x and a depth direction z, and the partition wall 30 may comprise a main baffle 301 and at least a secondary baffle 302 fixed to or integral with the main baffle 301, to stiffen it, where the main baffle 301 extends mainly along the depth direction z and along a height direction y whilst the at least a secondary baffle 302 extends mainly along the longitudinal direction x and the height direction y.

Preferably, the longitudinal direction x, the depth direction z and the height direction y are orthogonal to each other.

Even more preferably, for simplicity of production, the first base 10 and the second base 20 each comprise a plate-shaped element. The first base 10 may comprise a first plate-shaped element 101 and the second base 20 may comprise a second plate-shaped element 201. The first support surface 101*a* and the first lower surface 101*b* may, therefore, be respectively two opposite faces of the first plate-shaped element 101 while the second support surface 201*a* and the second lower surface 201*b* may be respectively two opposite faces of the second plate-shaped element 201.

The first plate-shaped element 101 and the second plate-shaped element 201 may comprise a first plurality of perimeter edges and a second plurality of perimeter edges, respectively. The first plurality of perimeter edges may comprise the first mating portion 102 and the second plurality of perimeter edges may comprise the second mating portion 202.

Even more preferably, for ease of construction and transport, the first plate-shaped element 101 and the second plate-shaped element 201 may be quadrangular in shape, preferably rectangular or square. In this case, the first plate-shaped element 101 is delimited by a first pair of perimeter edges parallel to the longitudinal direction x and a first pair of perimeter edges parallel to the depth direction z. Similarly, the second plate-shaped element 201 is delimited by a second pair of perimeter edges parallel to the longitudinal direction x and a second pair of perimeter edges parallel to the depth direction z.

The third portion 403 of the cover casing 40 may comprise a plate-shaped element fixed to perimeter edges parallel to the longitudinal direction x of both the first base 10 and the second base 20.

The partition wall 30 may comprise a main baffle 301 and at least a secondary baffle 302, integral or fixed to each other. The main baffle 301 may extend mainly in the depth direction z and in the height direction y. In this way, the main baffle 301 advantageously exerts a reinforcement force on the base with which it is associated by counteracting any twisting or warping in the length direction x. Preferably, the main baffle 301 is positioned abutting or at a perimeter edge of the first plate-shaped element 101 or the second plate-shaped element 201 parallel to the depth direction z. Even more preferably, the main baffle 301 has the same dimension, along the depth direction z, as the first base or of the second base 20 with which it is associated.

The reinforcement action exerted by the main baffle 301 is intensified by the at least one secondary baffle 302, which may extend mainly in the longitudinal x direction and in the height direction y. Preferably, the at least one secondary baffle 302 is positioned or made in such a way as to be transversal, or more preferably orthogonal, to the main baffle 301. Even more preferably, the secondary baffle 302 is configured as a lateral extension of the main baffle 301, so as to limit the overall size on the first support surface 101*a* or on the second support surface 201*a* to which the partition wall 30 is associated to allow a greater freedom in the arrangement of the elements of the electronic unit Me or of the mechanical unit Mm.

Even more preferably, in order to further reinforce the main baffle 301, the partition wall 30 may comprise a pair of secondary baffles 302. Preferably, the two secondary baffles 302 are configured as two lateral extensions of the main baffle 301. In other words, the main baffle 301 may extend, in the depth direction z, between the two secondary baffles 302. The pair of secondary baffles 302 may be associated with a pair of edges parallel to the longitudinal direction x of the first base or of the second base 20. The partition wall 30, according to this configuration, can be, for example, advantageously made by bending a sheet of metal.

In addition, the partition 30 may further comprise a stiffening wall 303 extending transversely to the at least one secondary baffle 302 and preferably extending between two secondary baffles 302 and which is fixed to or integral with the main baffle 301.

In particular, the stiffening wall 303 may be obtained by bending an edge flap of the main baffle 301 if this is obtained from a sheet metal, as also described in detail below.

In addition, the support assembly 1 may comprise one or more fixing walls 106 which can be associated and/or are associated with the first base 10 and which project from the first support surface 101*a* and are configured to support one or more components of the electronic unit Me of the motocondensing unit M. In other words, the first base 10 may be equipped with one or more walls 106 for fixing the elements of the electronic unit Me of the motocondensing unit M to the same base. That is to say, the one or more fixing walls 106 may act as brackets for anchoring the components of the electronic unit Me to the first base 10. The one or more fixing walls 106 increase the area of the first base 10 available for fixing or anchoring components of the electronic unit Me.

In addition, the one or more fixing walls 106 may be associated and/or are associated with the partition wall 30. Advantageously, the one or more fixing walls 106 may also serve as anchoring brackets for further elements, such as a box-shaped screen 60 for the containment of electromagnetic emissions from the components of the electronic unit Me, in particular of the controller. For example, a fixing wall 106 may be associated with the partition wall 30, in particular with the main baffle 301, so as to form a niche. The controller can be housed within the niche. Moreover, for covering at least the niche, a box-shaped screen 60 may be associated with the fixing wall 106 and/or the main baffle 301 to contain such electromagnetic emissions.

In addition, the one or more fixing walls 106 may be configured and positioned with respect to each other and/or with respect to the electrical/electronic components of the electronic unit Me and/or with respect to the partition wall 30 in such a way as to define channels for conveying the hot cooling air of the controller towards the outside of the support assembly 1, for example by means of grilles or openings made in the vertical wall 70, in order to prevent it from coming into contact with other electrical/electronic components of the electronic unit Me.

Heat sinks, of the traditional type and not illustrated, for example fins, may be fixed to, or integrally formed with, at least one of the fixing walls 106 to assist in the thermal dissipation of any electronic components, for example the controller, attached thereto.

Moreover, preferably, the first base 10 and the second base 20 may comprise a first frame 105 and a second frame 205 respectively. Advantageously, the first frame 105 and the second frame 205 are configured to give structural rigidity to the first base 10 and the second base 20, respectively. For example, the first frame 105 and the second frame 205 may comprise or consist of one profile or a plurality of profiles, wherein each profile may be fixed to a perimeter edge section of the first plate-shaped element 101 and the second plate-shaped element 201, respectively, or each profile may be integral with the perimeter edges.

For example, for structural and production simplicity, the perimeter edges of the first plate-shaped element 101 and the second plate-shaped element 201 may be made of sheet metal folded to form a closed section and may possibly be welded to the lower face 101*b*, 201*b* of the corresponding plate-shaped element 101, 201 to form such profiles. In other words, the first frame 105 and the second frame 205 can be made integrally to the first plate-shaped element 101 and the second plate-shaped element 201, respectively. For example, the first frame 105 and the second frame 205 may be made by successive bends of the perimeter edges towards the first lower surface 101*b* and towards the second lower surface 201*b*. In such a case, each of either the first base 10 and the second base 20 may be formed by a single panel of shaped, bent sheet metal and possibly welded for finishing.

Alternatively, the first frame 105 and the second frame 205 may be stably fixed, for example by means of screws or similar fastening means, to the first lower surface 101*b* and the second lower surface 201*b*, respectively. For simplicity of construction, in such a case, the first frame 105 and the second frame 205 may comprise a plurality of sections or pieces of metal profile, for example of rectangular or square cross-section, rigidly coupled together.

Moreover, advantageously, the first frame 105 and the second frame 205 may comprise one or more constraint zones configured for the insertion of screws, or similar fasteners, so as to enable a fastening of the cover casing 40.

In addition, the support assembly 1 may comprise a fin 204 which can be associated and/or is associated with the second base 20 and which projects from the second coupling side part 202 with respect to the second support surface 201*a*, and wherein the partition wall 30 can be associated and/or is associated with the first base 10, and wherein the fin 204 is configured in such a way as to abut against or lie against the partition wall 30, to be fixed thereto, following the coupling of the first coupling part 102 with the second coupling part 202. In other words, the second base 20 may be associated with, can be associated with or is made as one with a fin 204 protruding from the second support surface 201*a*. The fin 204 may be configured to rest against and be fixed to the partition wall 30. In particular, the fin 204 may be configured to strike against the main baffle 301 of the partition wall 30.

Advantageously, the fin 204 constitutes a further barrier to prevent any leakage of water, cooling fluid or lubricating oil from the mechanical unit Mm of the motocondensing unit M from reaching the electronic unit Me of the motocondensing unit M.

In addition, the support assembly 1 may comprise two or more anchoring elements 80 comprising a slot 81 which can be engaged by a user with a hook or hook-shaped rod to facilitate lifting of the support assembly 1. Preferably, the anchoring elements 80 are fixed rigidly to the first frame 105 and to the second frame 205. They can be placed in mutually symmetrical or specular positions. Overall, the support assembly 1 can extend along a longitudinal direction x, along a depth direction z and along a height direction y. The overall size of the support assembly 1 in the longitudinal direction x may be less than 1500 mm, preferably less than 1100 mm; the overall size of the support assembly 1 in the depth direction z may be less than 550 mm, preferably less than 450 mm; the overall size of the support assembly 1 in the height direction y may be less than 350 mm, preferably less than 250 mm. Preferably, the support assembly 1 has the shape of a rectangular parallelepiped.

The overall size of the support assembly 1 in the longitudinal direction x may be less than 1500 mm, preferably less than 1100 mm, in order to be particularly compact and to have a reduced visual impact when positioned in a visible region of the refrigerator.

The overall size of the support assembly 1 in the depth direction z may be less than 550 mm, preferably less than 450 mm, so as to be compatible with the depth of the refrigerators F available on the market.

The overall size of the support assembly 1 in the height direction x may be less than 350 mm, preferably less than 250 mm, in order to be particularly compact and to have a reduced visual impact when positioned in a visible region of the refrigerator.

The support assembly 1 can, for simplicity of construction and economy, be made by bending a metal sheet. In other words, the components of the support assembly can be produced by bending a sheet of metal. A metal sheet with a thickness of between 1 mm and 2.5 mm can be used; in particular having a thickness of between 1.2 mm and 1.5 mm.

Moreover, in this description the term fixed or fixable or fastening means the joining of two parts in such a way as to prevent their mutual movement so as to form with them a single rigid body.

The expressions "is associated with" or "can be associated with" or "associate with" mean the joining of two parts preferably in a fixed way, according to the meaning defined above.

The invention as it is conceived is susceptible to numerous modifications and variants, all falling within the scope of protection of the appended claims. Further, all the details can be replaced by other technically-equivalent elements. In practice, the materials used, as well as the contingent forms and dimensions, can be varied according to the contingent requirements and the background art. Where the constructional and technical features mentioned in the following claims are followed by signs or reference numbers, the signs or reference numbers have been used only with the aim of increasing the intelligibility of the claims themselves and, consequently, they do not constitute in any way a limitation to the interpretation of each element identified, purely by way of example, by the signs or reference numerals.

The invention claimed is:

1. A support assembly (1) for a motocondensing unit (M), wherein said motocondensing unit (M) comprises an electronic unit (Me) and a mechanical unit (Mm), wherein said support assembly (1) comprises:

a first base (10), configured to support the electronic unit (Me) of the motocondensing unit (M), and having a first coupling side part (102); and a second base (20), configured to support the mechanical unit (Mm) of the motocondensing unit (M), and having a second coupling side part (202);

wherein said first coupling side part (102) and said second coupling part (202) are configured to be coupled to each other in such a way that, following the coupling of said first coupling part (102) and of said second coupling part (202), the first base (10) and the second base (20) form a single body;

wherein said first base (10) has a first support surface (101*a*) and wherein said second base (20) has a second support surface (201*a*), and wherein said support assembly (1) further comprises:

a cover casing (40) which can be fixed or is fixed to the first base (10) and to the second base (20) and configured to delimit, in cooperation with the first base (10) and the second base (20), a chamber (50); and a partition wall (30), which can be associated or is associated with said first base (10) or with said second base (20), which projects from said first coupling side part (102) with respect to the first support surface (101*a*) or from said second coupling side part (202) with respect to the second support surface (201*a*) and which divides said chamber (50) into a first compartment (501) for housing said electronic unit (Me) of the motocondensing unit (M) and into a second compartment (502) for housing said mechanical unit (Mm) of the motocondensing unit (M).

2. The support assembly (1) according to claim 1, wherein said first coupling part (102) and said second coupling part (202) are configured to establish a reversible and stable coupling.

3. The support assembly (1) according to claim 1, wherein said first coupling part (102) and said second coupling part (202) are a side part of the first base (10) and of the second base (20), respectively, wherein said first coupling part (102) and said second coupling part (202) comprise coupling means (103, 203), wherein said coupling means (103, 203) comprise at least one male element (103), projecting from said first coupling part (102) or from said second coupling part (202), and a female element (203), fixed to said second coupling part (202) or to said first coupling part (102), respectively, and wherein said male element (103) and said female element (203) are mutually complementary to achieve a shape coupling.

4. The support assembly (1) according to claim 1, wherein said cover casing (40) comprises a first portion (401), which can be associated or is associated with the first base (10) covering said first compartment (501), and a second portion which can be associated and/or is associated with said second base (20) covering said second compartment (502).

5. The support assembly (1) according to claim 1, wherein said first base (10) and said second base (20) extend mainly along a longitudinal direction (x) and a depth direction (z), and wherein said partition wall (30) comprises a main baffle (301) and at least one secondary baffle (302) fixed to or integral with said main baffle (301), to stiffen it, and wherein said main baffle (301) extends mainly along said depth direction (z) and along a height direction (y), wherein said at least one secondary baffle (302) extends predominantly along said longitudinal direction (x) and in said height direction (y).

6. The support assembly (1) according to claim 1, comprising a fin (204) which can be associated or is associated with said second base (20) and which projects from said second coupling side part (202) with respect to said second support surface (201*a*), and wherein said partition wall (30) can be associated or is associated with said first base (10), and wherein said fin (204) is configured in such a way as to abut against or lie against said partition wall (30), and to be fixed thereto, following the coupling of said first coupling part (102) with said second coupling part (202).

7. The support assembly (1) according to claim 1, comprising one or more fixing walls (106) which can be associated and/or are associated with said first base (10) and which project from the first support surface (101*a*) and are configured to support one or more components of the electronic unit (Me) of the motocondensing unit (M).

8. The support assembly (1) according to claim 1, wherein said partition wall (30) is provided with at least one through hole (303) for allowing the passage of connection cables connecting the electronic unit (Me) to the mechanical unit (Mm) of the motocondensing unit (M), or said partition wall (30) is provided with through-wall connectors.

9. The support assembly (1) according to claim 1, wherein said support assembly (1) is developed along a longitudinal direction (x), along a depth direction (z) and along a height direction (y);

and wherein the overall size of the support assembly (1) in the longitudinal direction (x) is less than 1500 mm;

and wherein the overall size of the support assembly (1) in the depth direction (z) is less than 550 mm;

and wherein the overall size of the support assembly (1) in the height direction (y) is less than 350 mm.

10. The support assembly (1) according to claim 2, wherein said first coupling part (102) and said second coupling part (202) are a side part of the first base (10) and of the second base (20), respectively, wherein said first coupling part (102) and said second coupling part (202) comprise coupling means (103, 203), wherein said coupling means (103, 203) comprise at least one male element (103), projecting from said first coupling part (102) or from said second coupling part (202), and a female element (203), fixed to said second coupling part (202) or to said first coupling part (102), respectively, and wherein said male element (103) and said female element (203) are mutually complementary to achieve a shape coupling.

11. The support assembly (1) according to claim 1, wherein:

said support assembly (1) is developed along a longitudinal direction (x), along a depth direction (z) and along a height direction (y);

and wherein the overall size of the support assembly (1) in the longitudinal direction (x) is less than 1100 mm;

and wherein the overall size of the support assembly (1) in the depth direction (z) is less than 450 mm;

and wherein the overall size of the support assembly (1) in the height direction (y) is less than 250 mm.

* * * * *